US005195594A

United States Patent [19]

Allen et al.

[11] Patent Number: 5,195,594

[45] Date of Patent: Mar. 23, 1993

[54] APPARATUS AND METHOD FOR RAPIDLY AND RELIABLY SEALING OFF CERTAIN EXIT AND ENTRANCE WAYS IN RESPONSE TO SMOKE OR FIRE

[76] Inventors: Thomas H. Allen, 2004 N. 10th St., Boise, Id. 83702; Dale G. Hobson, 10622 W. Sandpiper St., Boise, Id. 83709

[21] Appl. No.: 744,079

[22] Filed: Aug. 12, 1991

[51] Int. Cl.[5] ..... A62C 2/10

[52] U.S. Cl. ..... 169/48; 160/7; 160/243; 160/268.1

[58] Field of Search ..... 169/48, 51; 160/1, 6, 160/7, 243, 268.1, 273.1, 242

[56] References Cited

U.S. PATENT DOCUMENTS

| | | | |
|---|---|---|---|
| 3,766,958 | 10/1973 | Mitchell | 169/48 X |
| 4,077,474 | 3/1978 | Hattori | 160/1 X |
| 4,079,772 | 3/1978 | Klaenhammer et al. | 160/268.1 X |
| 4,398,371 | 8/1983 | Jenkins | 160/1 X |

FOREIGN PATENT DOCUMENTS

| | | | |
|---|---|---|---|
| 2617230 | 12/1988 | France | 169/48 |
| 2060744 | 5/1981 | United Kingdom | 160/268.1 |
| 2108839 | 5/1983 | United Kingdom | 169/48 |

*Primary Examiner*—Charles A. Marmor
*Assistant Examiner*—Gary C. Hoge
*Attorney, Agent, or Firm*—William J. Bethurum

[57] ABSTRACT

A method and apparatus for rapidly and reliably sealing off a selected exit way or entrance way from an adjacent path of smoke which comprises providing a reel of fire resistant material and having magnetic edge strips on each side thereof above said exit way or entrance way, and causing the reel to drop in vertical fall adjacent to the exit way or entrance way and simultaneously cause magnetized strips on a fire retardant curtain wound on the reel to become rapidly and magnetically attached to the exit way or entrance way upon the nearby condition of either smoke or fire. This apparatus is elegantly simple and reliable in both its construction and operation and has an extremely high price/performance figure of merit.

15 Claims, 13 Drawing Sheets

APPARATUS AND METHOD FOR RAPIDLY AND RELIABLY SEALING OFF CERTAIN EXIT AND ENTRANCE WAYS IN RESPONSE TO SMOKE OR FIRE

TECHNICAL FIELD

This invention relates generally to safety apparatus for shielding humans from harmful exposure to smoke or fire. More particularly, the safety apparatus described herein responds to conditions of either smoke or flame to rapidly and reliably seal off certain passageways, such as elevator shafts, while simultaneously affording entry or exit through the sealed off area if such becomes necessary.

BACKGROUND ART

In order to protect humans against smoke or fire which may erupt in a variety of building structures, and particularly in large office buildings, hotels, and the like, many different types of shielding devices have been developed over the years which are operative to seal off certain exit and entrance ways through which smoke is likely to travel. As is well known, many fire related deaths are the result of smoke inhalation, so there have been various different approaches proposed to rapidly sealing off areas adjacent to which smoke is likely to travel very swiftly once a fire anywhere in that path has been started. An example of one such path is that defined by an elevator shaft which creates a low resistance and sometimes well drafted and well defined large area path for smoke to travel and become rapidly drawn into any opening into the path between floors of a building.

Examples of such prior patented approaches to sealing off certain exit and entry ways, such as elevator doors, are disclosed in U.S. Pat. No. 2,947,239 issued to Burgess, U.S. Pat. No. 3,807,480 issued to Smart, U.S. Pat. No. 3,960,216 issued to Isobe, in U.S. Pat. No. 4,971,994 issued to Ho and in U.S. Pat. No. 4,766,958 issued to Mitchel, all incorporated herein by reference.

Other prior approaches to sealing off elevator doors and other selected entrance and exit ways for the purpose of smoke isolation in case of fire include horizontally and vertically driven sliding doors and spring biased doors of various types. These latter types of prior art elevator sealing approaches have exhibited many operational disadvantages and have been difficult to economically manufacture and maintain. In addition, many of these schemes not directly located at an elevator door require the dedication of valuable floor space on one or both sides of the elevator lobby which cannot be used for other office purposes.

DISCLOSURE OF INVENTION

The general purpose and principal object of the present invention is to provide a novel alternative approach with respect to any and all of the above or other known prior art approaches to sealing off an entrance way, exit way, or opening in the path of smoke in the event of a fire.

Another object of this invention is to provide a new and improved method and apparatus of the type described which is extremely rapid in its operation.

Another object of this invention is to provide a novel area sealing method and sealing mechanism of the type described which is reliable in operation and is relatively easy to install.

Another object of this invention is to provide a novel method and apparatus of the type described which is elegantly simple in both construction and operation and which operates with an absolute minimum of moving parts.

Another object of this invention is to provide a new and improved method and apparatus of the type described which is characterized by an extremely high price/performance figure of merit.

A novel feature of this invention is the provision of a fire resistant curtain and having magnetic edge strips thereon adapted to be wound on a reel, whereby the vertical release of the reel adjacent to a passageway having metal or metallic sections thereon enables these magnetic edge strips to become magnetically attracted to these metal or metallic sections to thereby rapidly seal off an adjacent passageway.

Another feature of this invention is the provision of a thin strip of two staged heat process laminating adhesive attached to the magnetic strips which chemically bonds to the metal frame as the air temperature increases due to the hot smoke.

Another feature of this invention is the provision of an expansion joint between the film and magnet which allows proper film shape upon inflation by air pressure caused by the smoke.

Another feature of this invention is the provision of a reel for winding the fire retardant curtain thereon and a housing for containing the reel above a passageway to be sealed off in case of smoke or fire. The housing further contains means therein for releasing the reel in vertical fall adjacent the edges of the passageway in response to a smoke or flame detection signal.

Another feature of this invention is the provision of end spring reels mounted on each end of the reel and having wires wound thereon and attached to the interior walls of the housing. These spring reels restrain the fall of the fire retardant curtain and provide a method of rewinding the curtain into the housing.

Another feature of this invention is the provision of electrical control means which are connected to a smoke or flame detector and are responsive to a smoke or flame detection signal for releasing the reel from its housing, thereby initiating the vertical drop of the reel and curtain adjacent to the edges of the passageway to be sealed off.

Another feature of this invention is the provision of a door hinged at one end of the reel housing and having a solenoid-operated latch mounted on an inner surface of the door and responsive to a control signal from the smoke or flame detector for opening the door and releasing the reel from its housing.

Another feature of this invention is the provision of an extension brace for the apparatus described that when operative, holds the reel a determinant length away from the edges of the passageway to be sealed off.

Another feature of this invention is the provision of metallic strips attached to the outer surface of the magnetic edge strips to aid in rolling up the apparatus and to enhance the magnetism.

Another feature of this invention is the provision of a rigging system to easily manually rewind the apparatus into the housing.

The above purpose, objects and related advantages and novel features of this invention are accomplished by the provision of a new and improved method and apparatus including:

a. means including a reel of fire resistant material having magnetic edge strips or sections thereon, and b. means electrically coupled between a smoke or flame detector and the reel of fire resistant material for releasing the reel in free or restrained fall and in close proximity to an exit way or an entrance way desired to be sealed off, whereby the magnetic edge strips falling in close proximity to the exit way or entrance way become rapidly pulled toward and magnetically attracted to the surface thereof.

In accordance with the method of operation disclosed and claimed herein, this novel sequence of method steps includes:

a. providing a reel of fire and smoke resistant material in proximity to the top of an adjacent exit way or entrance way to be sealed off in the event of smoke or fire, b. dropping the reel in free or restrained fall adjacent to a surface of the exit way or entrance way and in response to the detection of a smoke or flame-responsive electrical signal, while simultaneously c. attaching by magnetic attraction the edge surfaces of a fire retardant curtain wound on the reel during the fall to the adjacent surfaces of the exit way or entrance way, thereby rapidly sealing off of the exit way or entrance way in case of smoke or fire.

DESCRIPTION OF THE PREFERRED EMBODIMENT

Figure 1A:
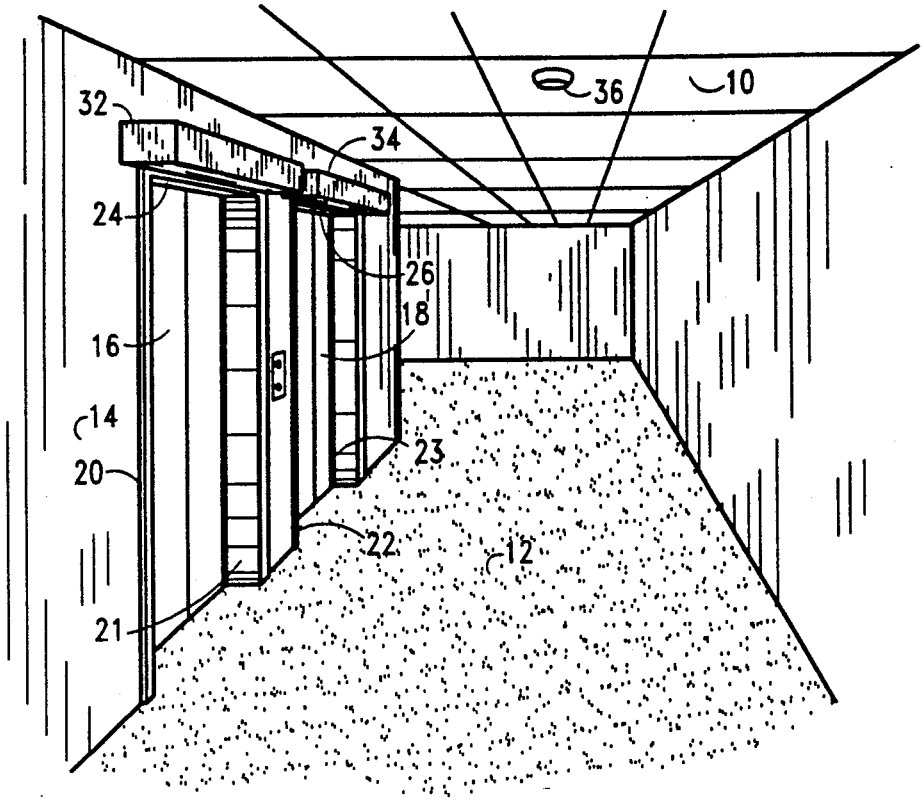
FIG. 1A is an isometric view of an elevator lobby in which the sealing apparatus according to the present invention has been installed for operation over the tops of each of two adjacent elevator doors.

Referring now to FIG. 1A, there is shown an elevator lobby including a ceiling 10, a lobby floor 12, and vertical adjoining walls 14 defining an area within which two elevator doors 16 and 18 are constructed as shown. Each of the elevator doors 16 and 18 is surrounded by metal door jamb frames 20, 21, and 22, 23 which include the two vertical metal strips for each door and adjoining horizontal top head frames 24 and 26.

Each of the elevator doors 16 and 18 is provided with an elongated container housings 32 and 34 mounted as shown over the tops of each of the horizontal door frames 24 and 26. Each of these two container housings 32 and 34 contain therein a reel of fire resistant material., in the form of a curtain which is wound on a cylinder or reel and which includes a strip of preselected magnetic material located along each of the two side edges and top edge of each curtain contained in each of the two housings 32 and 34, respectively. The two reel housings or containers 32 and 34 further include therein electrical controls to be described below which is electrically connected to a smoke detector 36 mounted as shown in the ceiling 10 of the elevator lobby. The two reel containers 32 and 34 are operative upon receipt of an electrical signal from the smoke or fire detector 36 to drop each reel within each container housing 32 and 34 in a vertical fall adjacent the metal elevator door jamb frames 20, 21, 22, 23, and elevator head frames 24, and 26. Each of the reels may, if desired, be dropped either in free fall or dropped with a controlled and restrained acceleration until these reels reach the lobby floor 12 where they become sealed at the bottom of these two elevator doors 16 and 18.

Figure 1B:
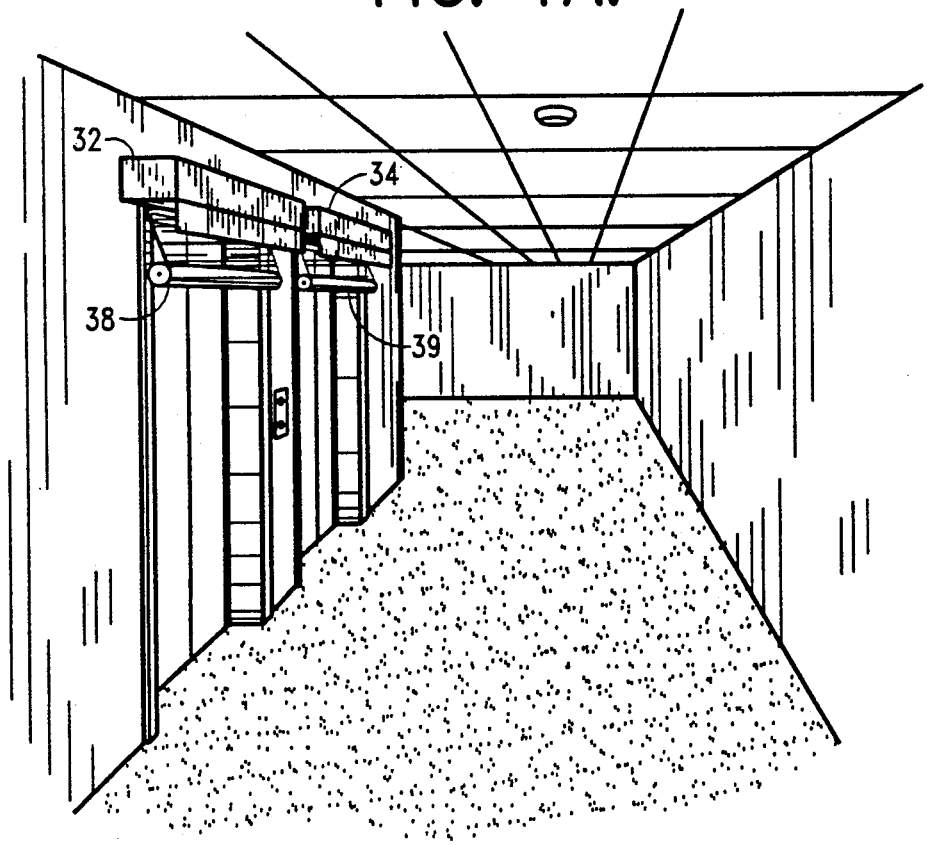
FIG. 1B is an isometric view modification of FIG. 1A wherein the smoke or fire alarm has just provided the signal to open or close contacts and energize the sealing apparatus and thereby initiate the vertical fall motion of the reel of fire resistant material from its external housing.
Figure 1C:
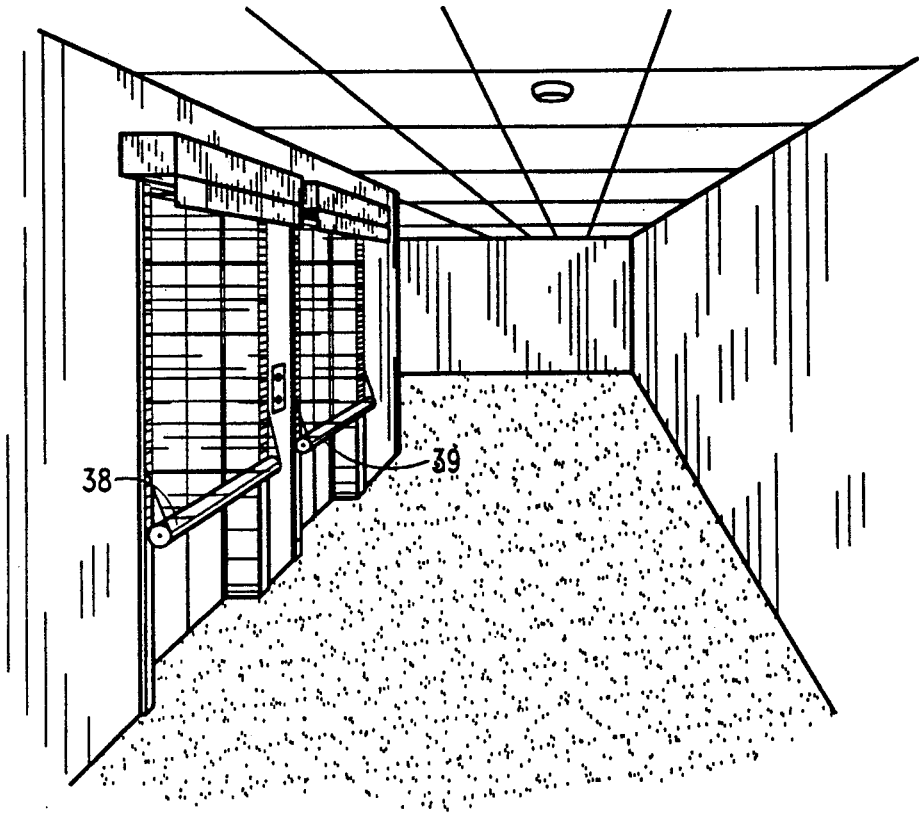
FIG. 1C is an isometric view modification of FIG. 1B above where the fire resistant reel of material has dropped just over one half way down the vertical length dimension of the elevator door.
Figure 1D:
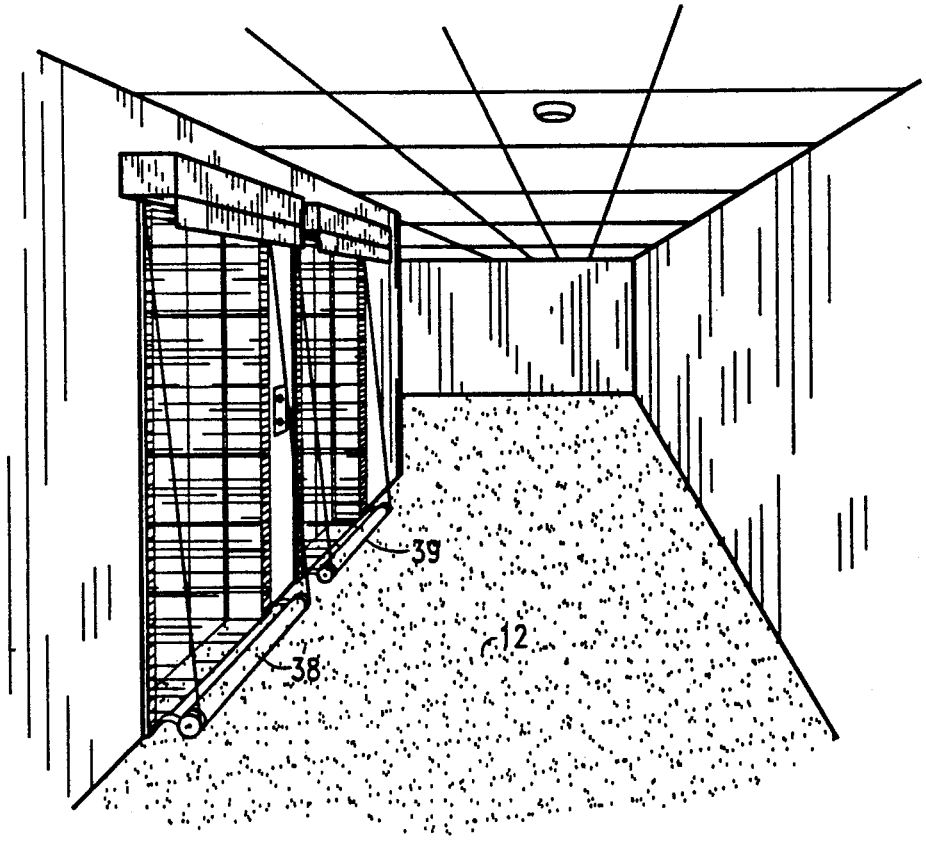
FIG. 1D is an isometric view modification of FIG. 1C above where the reel of fire resistant material has reached the floor adjacent to the bottom of the elevator door and there becomes tightly sealed to the vertical metal door frames and the floor defining each elevator entrance way.

Referring now in sequence to FIGS. 1B, 1C, and 1D, the isometric view in FIG. 1B shows the reels 38 and 39 as they have just exited the two container housings 32 and 34, whereas the isometric view in FIG. 1C shows these two reels 38 and 39 at approximately their half way point of vertical drop from the two container housings.

The isometric view in FIG. 1D shows the two reels 38 and 39 after they have reached the lobby floor 12.

Figure 2:
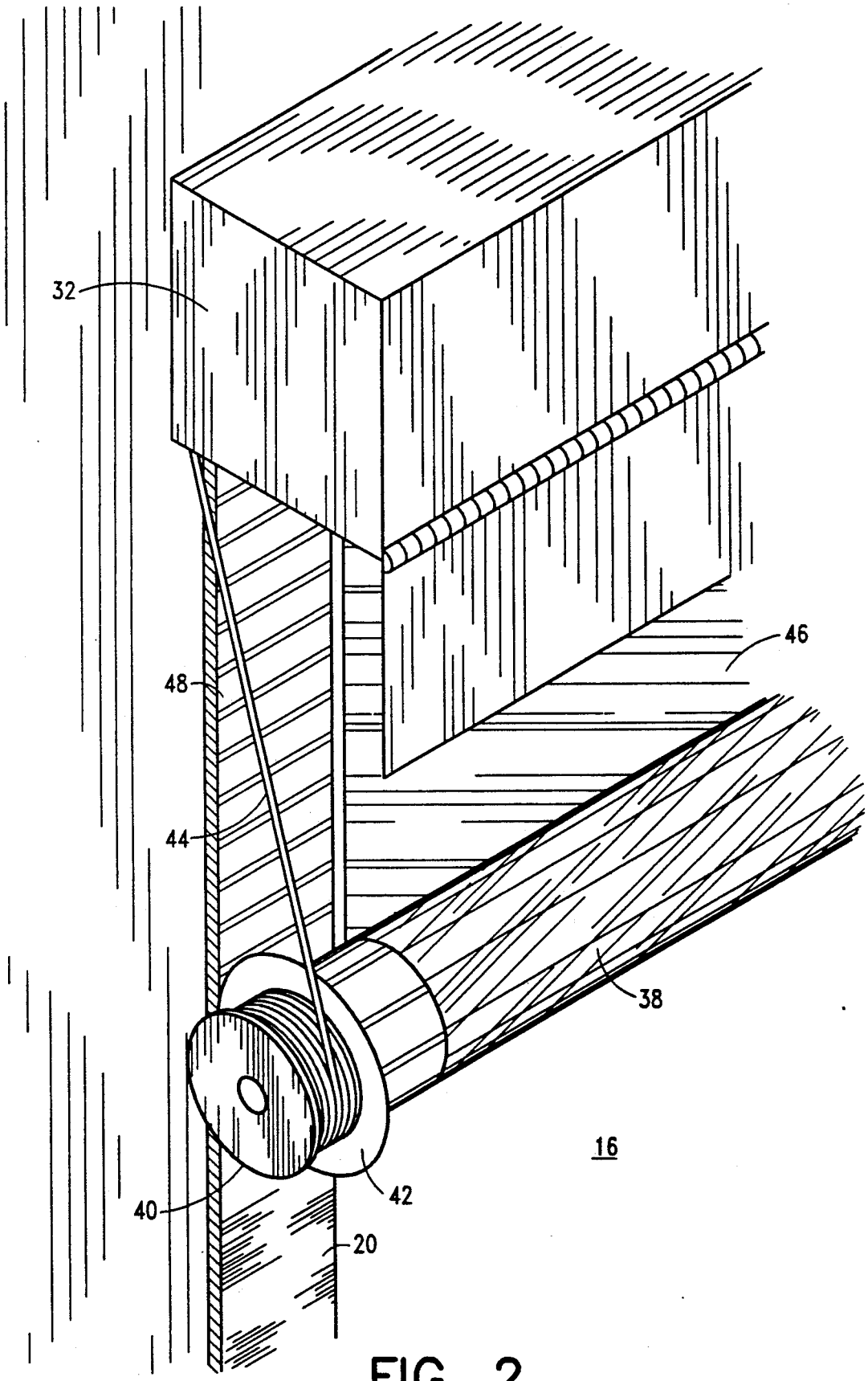
FIG. 2 is an enlarged fragmented isometric view corresponding to FIG. 1B above and specifically illustrating the unrolling of the curtain of fire retardant material and the corresponding attachment of a magnetic edge strip on or within the curtain to the metal edge of the adjacent elevator door frame.

Referring now to FIG. 2, there is shown in an enlarged fragmented isometric view corresponding to FIG. 1B one end of the reel 38 which has a spring reel 40 thereon having a peripheral groove 42 for receiving a metal wire 44 which extends up into the elongated box-like container housing 32 and is operative to restrain the acceleration of the reel 38 when it is dropped vertically from the container housing 32 in response to a signal from the smoke or fire detector 36 shown in FIGS. 1A through 1D. A curtain 46 of a suitable fire resistant material is wound on the reel 38 so that one end of the fire resistant curtain 46 is secured firmly to the reel proper. A thin flexible magnetized strip 48 is affixed to each edge of the curtain 46, and the curtain 46 and its magnetized strip 48 have been sized so that the curtain 46 and strip 48 are extended fully to their vertical length when the reel 38 comes to rest against the lobby floor 12. The magnetized strip 48 rapidly attaches to the elevator door frame 20 when the apparatus drops thereby reliably sealing off of elevator door 16.

Figure 3:
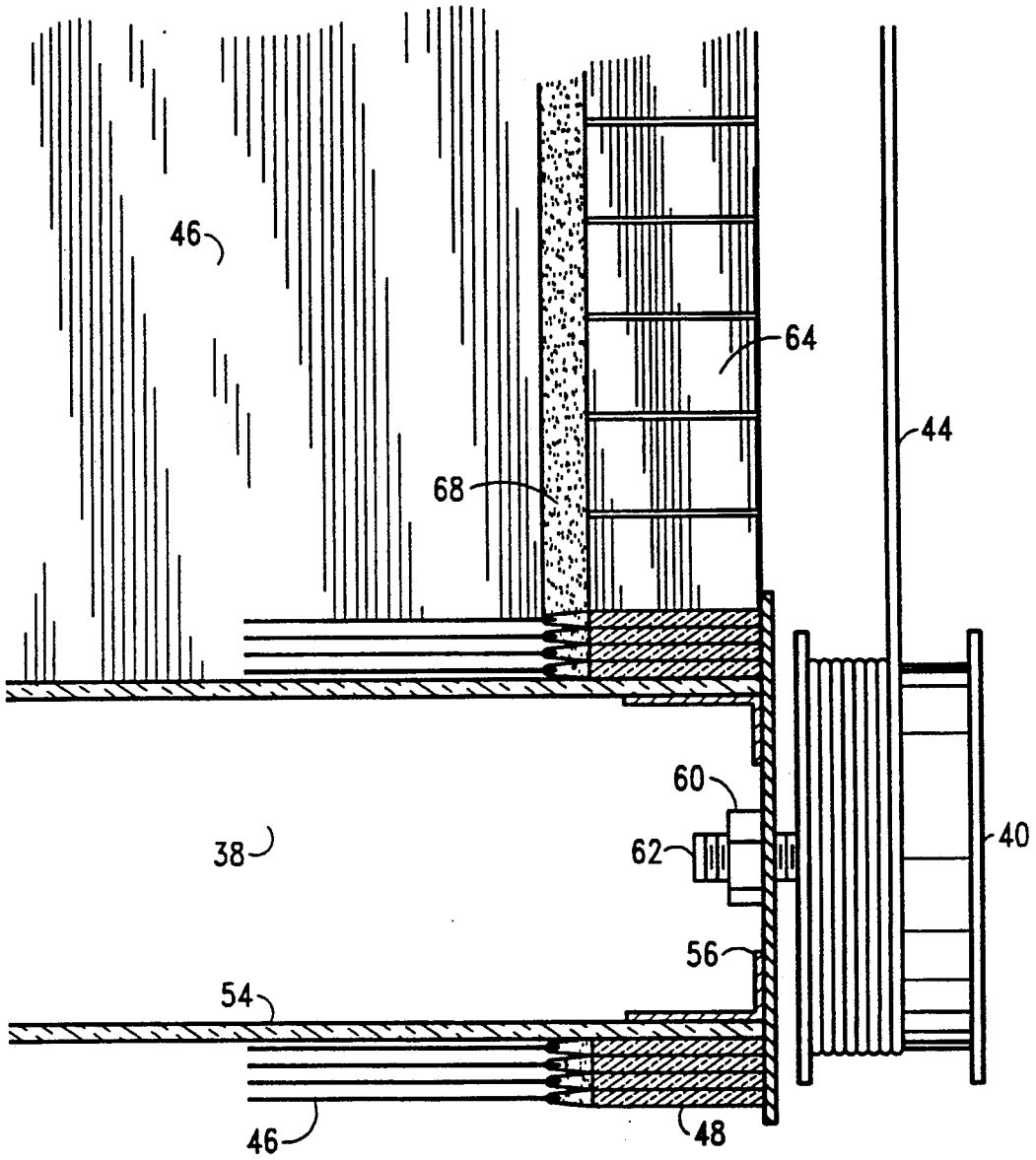
FIG. 3 is a partial elevation and partially cross sectioned elevation view of one end of the fire retardant reel which is operatively mounted within each housing above each elevator door.

Referring now to FIG. 3, the end of the reel shown in this figure by cut away section is again designated generally as 38, and it includes a hollowed-out cylinder 54 which is capped with an end piece 56 and surrounded on its exterior surface by the fire retardant curtain 46 to which the flexible magnetic edge strips 48 are secured. The spring reel 40 contains the metal wire 44 previously described, and the spring reel 40 is threaded through an opening in the end plate end cap 56 by a nut 60 and a bolt 62. The curtain 46 is attached to the flexible magnet 40 with a silicone sealant joint 68. Thin metal strips 64 are attached to the flexible magnet 48.

Figure 4A:
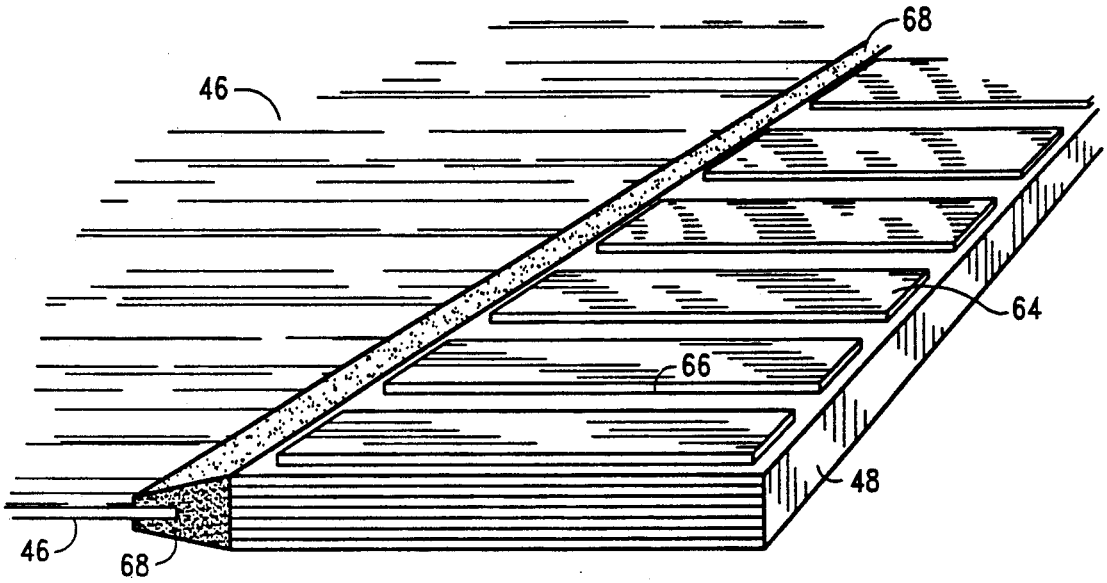
FIG. 4A is an enlarged cross sectional top view showing the attachment of the fire retardant curtain to a flexible strip of magnetic material at the top and side edges of the fire retardant curtain.

Referring now to FIG. 4A, this figure shows a top view of how the flexible magnet 48 is joined to the fire retardant curtain 46, and this is accomplished by the use of a silicone sealant joint 68 at the bonding interfaces of the flexible magnet 48 and the film members 46. Thin metal strips 64 are attached to the flexible magnet 48 by an adhesive strip 66.

Figure 4B:
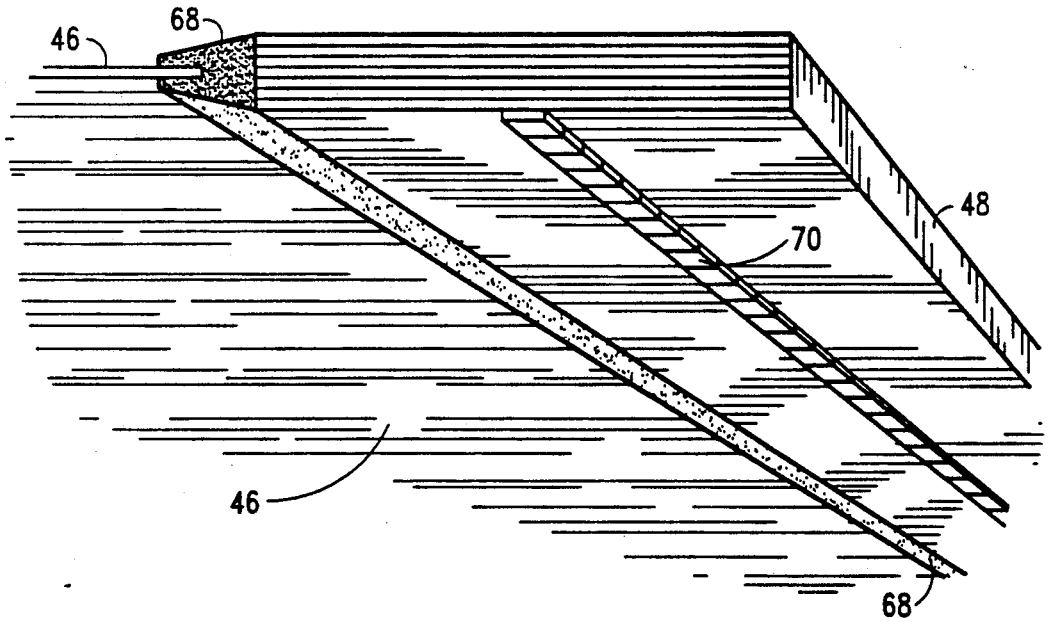
FIG. 4B is an enlarged cross sectional bottom view showing the attachment of the fire retardant curtain to a flexible strip of magnetic material at the top and side edges of the fire retardant curtain.

FIG. 4B shows a bottom view of the flexible magnet 48 connected to the fire retardant curtain 46 by a silicone sealant joint 68. Also illustrated is a strip of two staged heat process laminating adhesive 70 attached along the center of the flexible magnet 48.

Figure 5A:
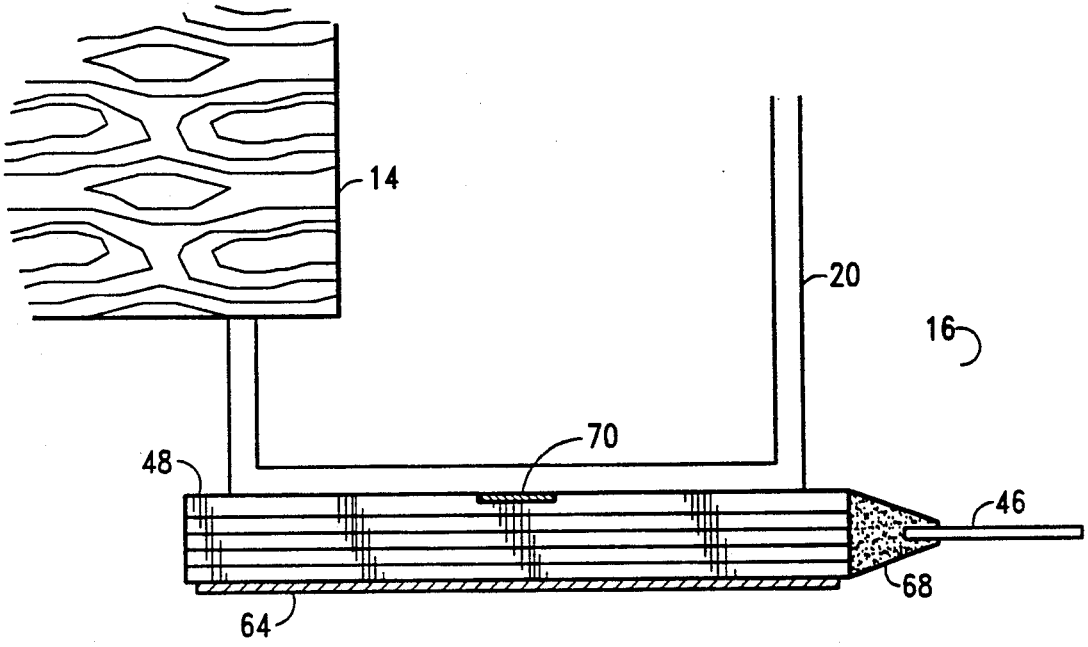
FIG. 5A is a cross section view of the flexible strip of magnetic material and fire retardant curtain directly adjacent to the elevator door frame.

Referring now to FIG. 5A, this figure shows a cross section of the lobby face of the elevator door frame 20 in conjunction to the lobby wall 14 and depicts the relative location of the flexible magnet 48, the silicone sealant joint 68, the fire retardant curtain 46, the laminating adhesive 70, and the metallic strips 64 within the elevator door opening 16.

Figure 5B:
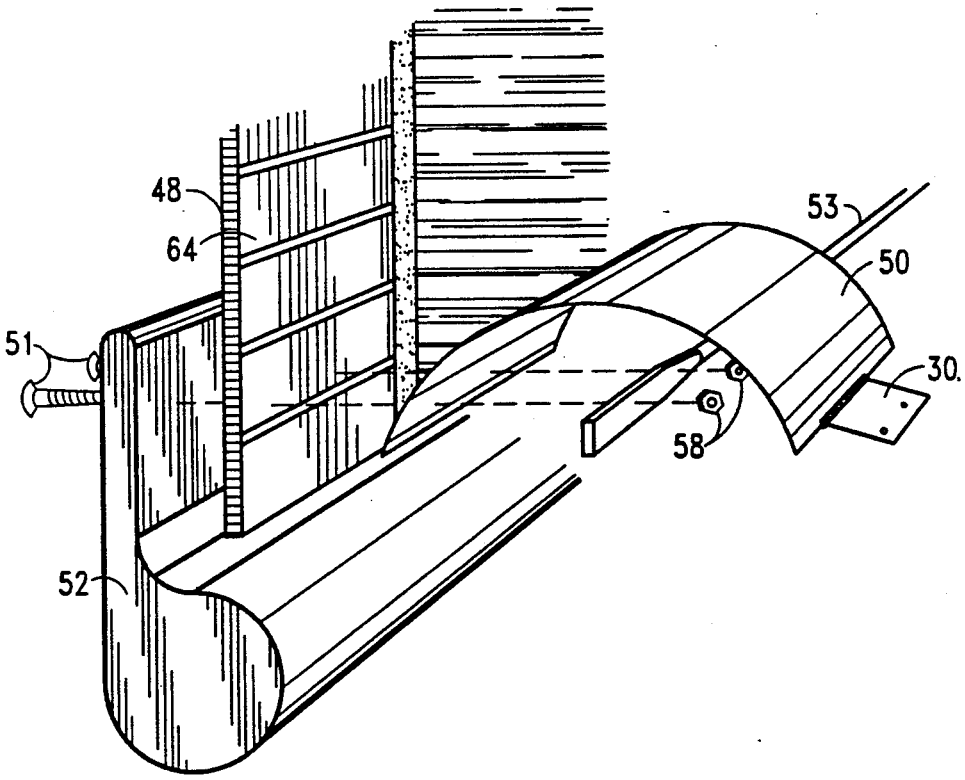
FIG. 5B is an exploded view of the bottom condition showing the flexible magnet attached to an extension brace and threshold material.

FIG. 5B illustrates an enlarged view showing the bottom condition of the apparatus. In this view, a semi-circular extension brace 50 is attached to the metallic strip 64 and to the flexible magnet 48 with two bolts 5 extending through the threshold material 52. The metal brace 53 is attached to the semi-circular extension brace 50 with two nuts 58 on the ends of the two bolts 51. A hinge 30 is attached to the semi-circular extension brace 50.

Figure 6A:
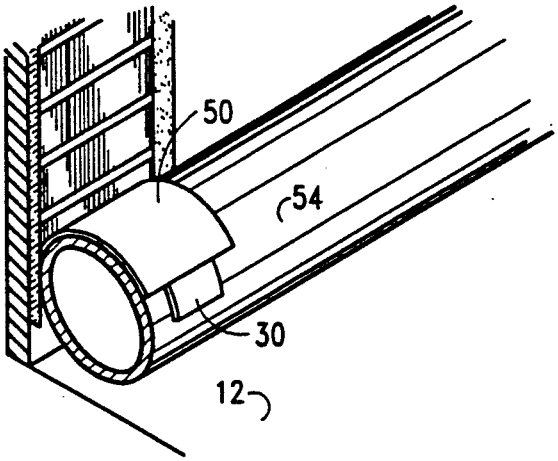
FIG. 6A, 6B, and 6C are isometric views of the reel and the extension bracket at the lobby floor.

Referring now to FIG. 6A, there is shown in an expanded fragmented isometric view, corresponding to FIG. 1D, the cylinder 54 at the lobby floor 12. A semi-circular extension brace 50 is attached to the cylinder 54 with a hinge 30. The threshold material is not depicted in this figure for clarity.

Figure 6B:
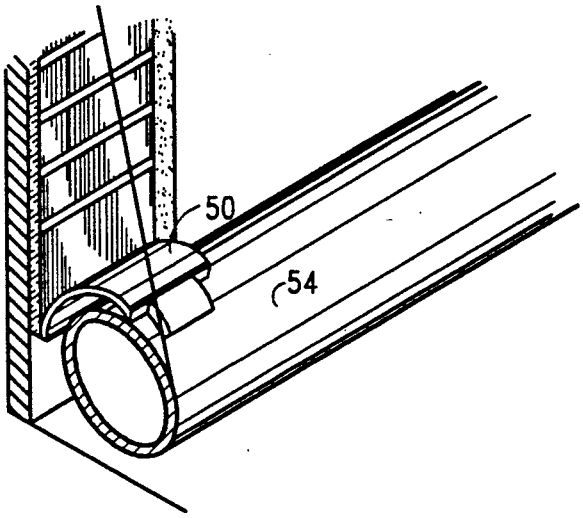

FIG. 6B shows the extension brace 50 opening due to the rotational momentum of the cylinder 54 caused by the momentum of the falling reel once it has reached the floor.

Figure 6C:
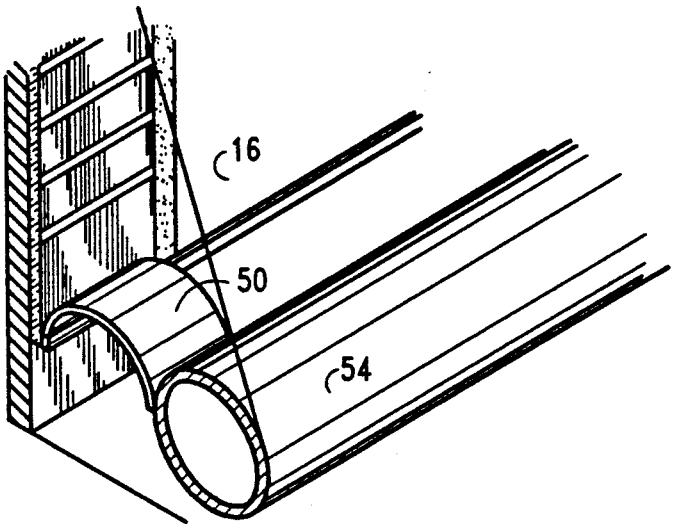

FIG. 6C shows the extension fully extending the cylinder 54 from the opening of the elevator door 16.

Figure 7A:
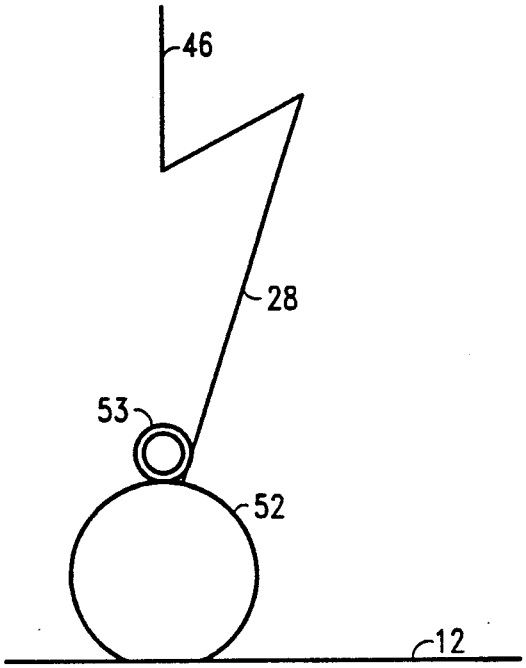
FIG. 7A, 7B, 7C, and 7D are sectional and isometric views, respectively, of the folded bottom portion of the curtain expanding under pressure.
Figure 7B:
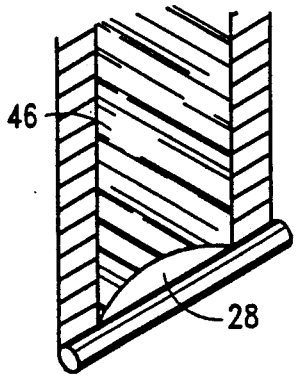
Figure 7C:
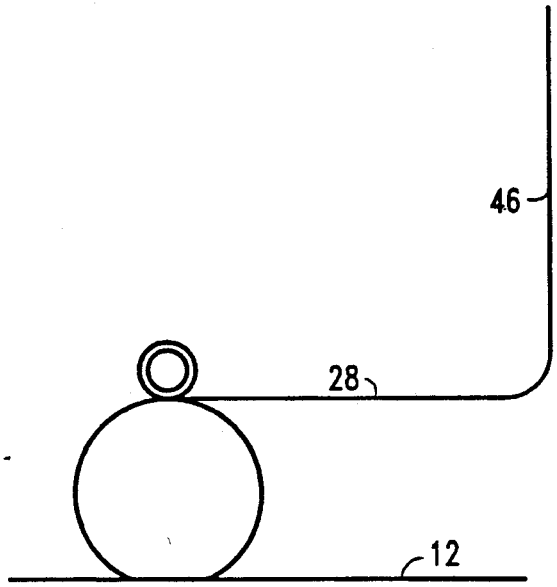
Figure 7D:
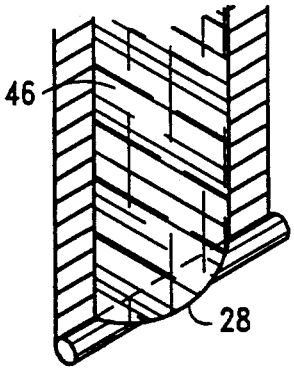

Referring now to FIG. 7A, 7B, 7C, and 7D which show how the fire retardant material 46 expands under pressure. FIG. 7A shows a fold 28 in the fire retardant material 46 which is attached to the metal brace 53 and to the threshold material 52 meeting the lobby floor 12. FIG. 7B shows an isometric view of the lower portion of the apparatus identifying the location of the fold 28 in relation to the fire retardant material 46. FIG. 7C shows the position of the fold 28 when the fire retardant material 46 is expanded under pressure in relation to the lobby floor 12. FIG. 7D shows an isometric view of the lower portion of the apparatus identifying the location of the fold 28 in relation to the fire retardant material 46 under pressure.

Figure 8:
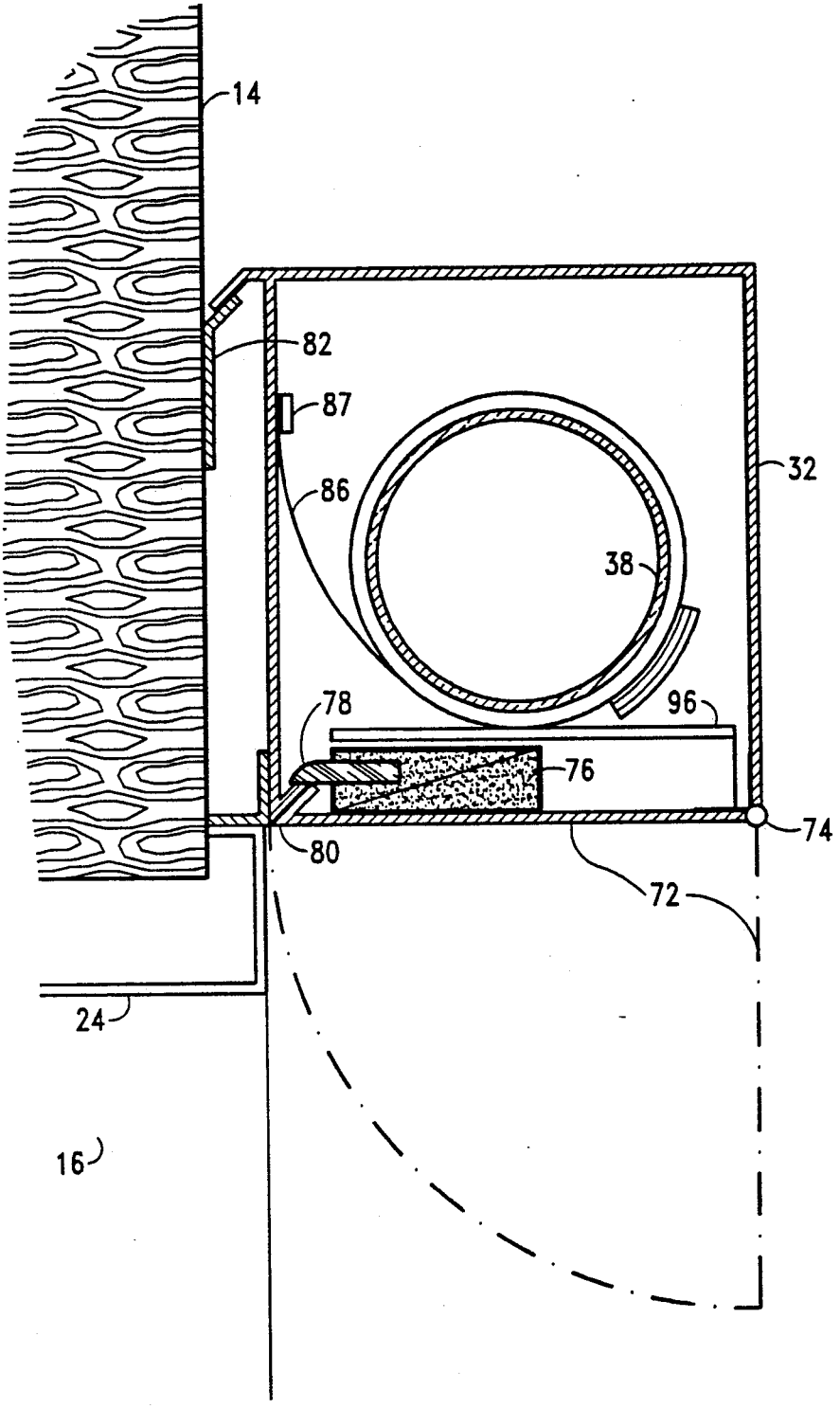
FIG. 8 is a cross section view taken through the center of each reel housing having the reel therein in a "ready" state and prepared for dropping the fire retardant curtain in vertical fall to seal off the elevator door passageway.

Referring now to FIG. 8, the rectangularly-shaped reel container housing 32 includes a lower door 72 pivotally mounted on a hinge 74 and the door 72 supports a solenoid-driven electrical strike member 76. The electrical strike member 76 has a retractable plunger 78 extending as shown onto a stop member 80, and the plunger 78 is in its extended position with the reel 38 being fully contained in a "ready" condition within the container housing 32.

The container housing 32 is set on top of and aligned with the wall mounting bracket 82 which is secured to the lobby wall 14 above the elevator door opening 16. The container housing 32 is placed adjacent to the elevator head frame 24 so that the container door 72 clears the elevator head frame 24 when the plunger 78 retracts and the container door 72 opens. The reel 38 is attached to the container housing 32 with a short piece of fire retardant curtain 86 connected to an adjustment bar 87. Two spacers 96 hold the reel 38 above an electrical strike member 76.

Figure 9:
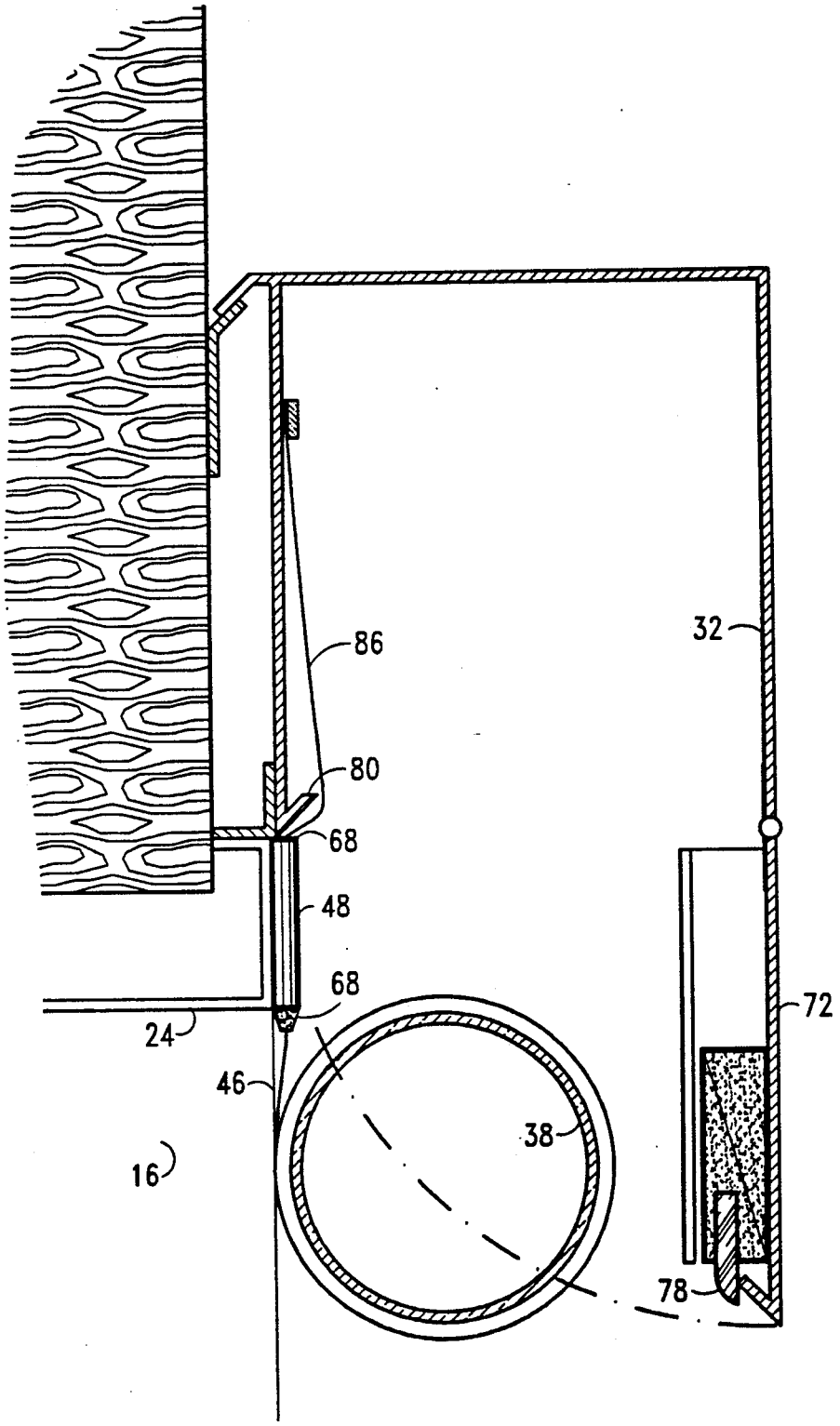
FIG. 9 is a cross section view taken through the center of each reel housing showing the falling condition of the reel shortly after the device is deployed.

FIG. 9 shows the apparatus initiating the vertical fall motion upon receiving a signal to open or close contacts and energize the sealing apparatus retractable plunger 78 releases from the stop member 80 thereby allowing the door 72 to swing in a downward manner. This operation thus allows the reel 38 to be released from the container housing 32 and fall downward at a controlled acceleration sufficient to optimize the sealing of the opening 16. The flexible magnet 48 attached to the short piece of the fire retardant curtain 86 and to the fire retardant curtain 46 with a silicone sealant joint 68 is magnetically attracted to the elevator door head frame 24 sealing the top of the elevator door opening 16.

Figure 10:
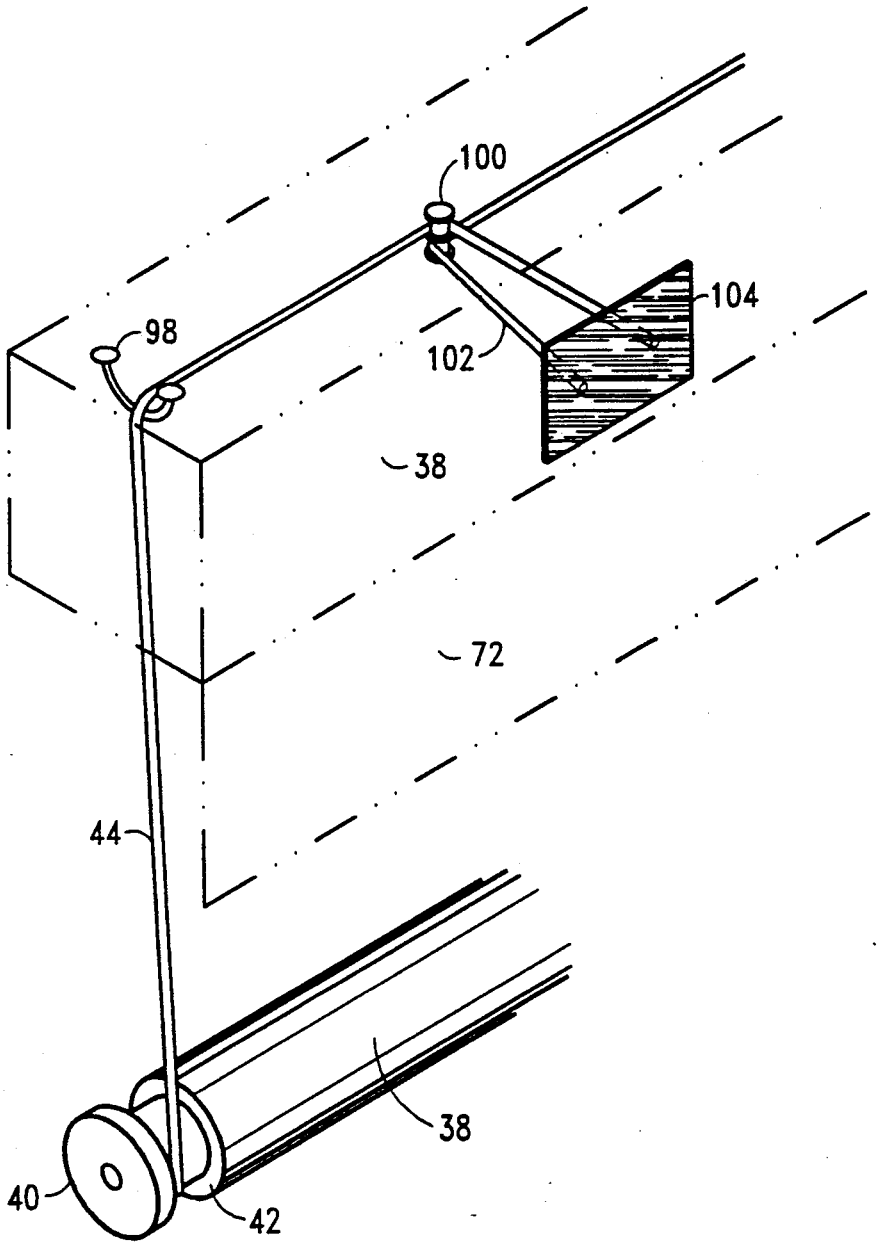
FIG. 10 is an isometric view with the reel housing shown with hidden lines showing how the wire line is rigged to retract the reel.

Referring now to FIG. 10, the container housing 38 is shown in isometric view with hidden lines. The wire 44 attached to the spring reel 40 and wound around the peripheral groove 42 extends through a U-shaped guide 98 attached to the top of the container housing 38. The wire 44 continues around a double pulley 100 centered and attached to the top of the container housing 38. At this location the wire 44 continues through a hole grommet 102 and is attached to the back of the face plate 104. Exerting an outward force on the face plate 104 creates tension in the wire 44 when the tension in the wire is greater than the force exerted by the spring reel and wind the spring reel 40 up into the container housing -8. Once the reel 38 is completely retracted within the container housing 38, the bottom door 72 may be shut and latched. The face plate 104 is then allowed to return the wire 44 being wound by the spring reel 40 onto the peripheral groove 42.

Figure 11:
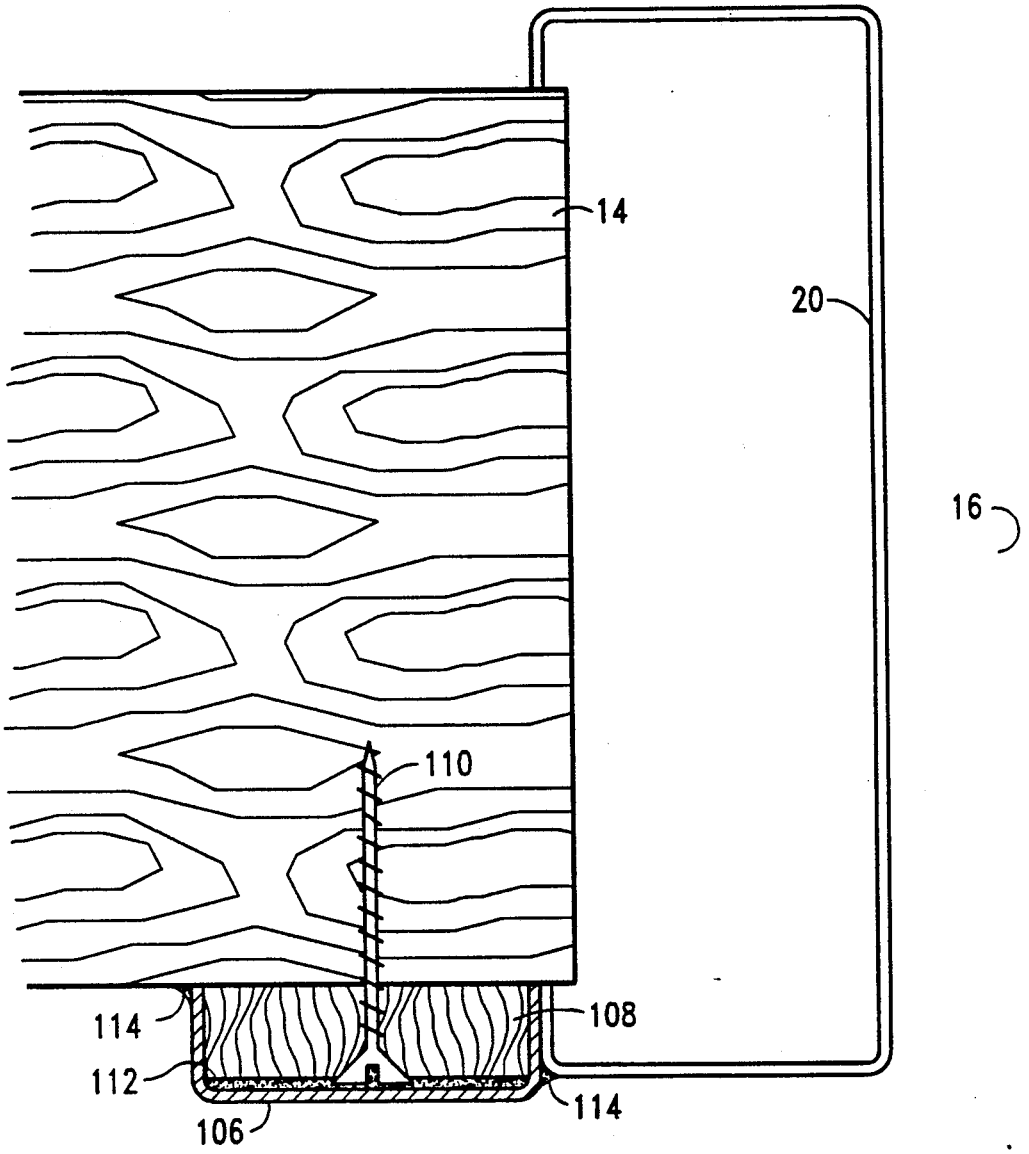
FIG. 11 is a cross section view showing a section of an elevator door frame and depicting an auxiliary frame which may be required on elevator door openings not meeting certain pre-established conditions.

Referring now to FIG. 11, the elevator door jamb frame 20 is shown in its relationship to the lobby wall 14 and to the elevator door opening 16. In some cases an auxiliary door frame 106 will be required at the perimeter of the elevator door frame. A solid section of wood 108 is secured to the lobby wall 14 with a series of countersunk screws, bolts, or anchors 110. The auxiliary metal or metallic door frame 104 is secured to the section of wood 108 with a silicone sealant 112. Clear silicone sealant 114 is applied to the joint between the auxiliary door frame 106 and the lobby wall 14 as well as the joint between the auxiliary door frame 106 and the elevator door frame at the perimeter of the elevator door opening 16.

Figure 12:
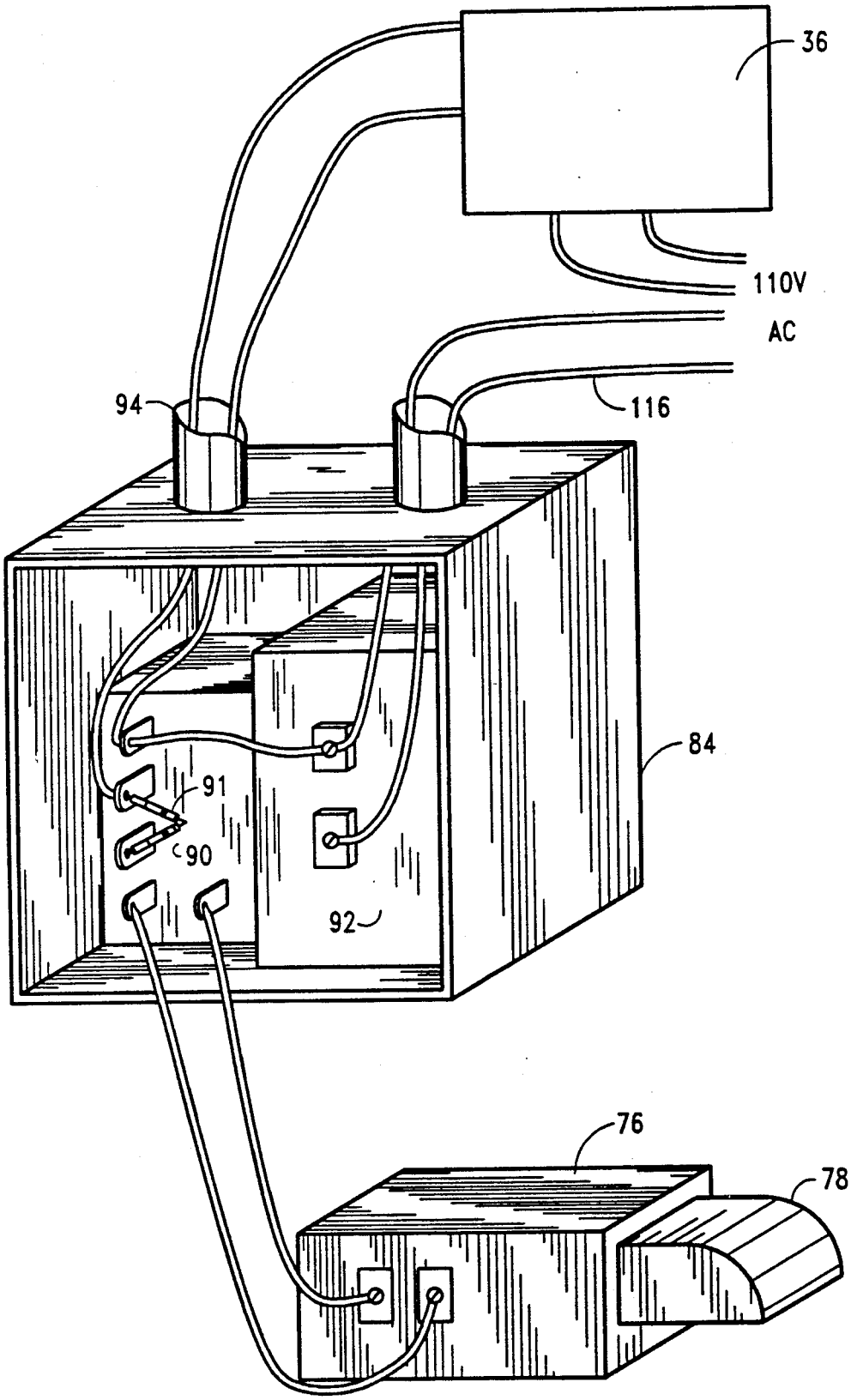
FIG. 12 is a cut-away isometric view of the control box housing having the cover plate thereof removed in order to expose the reel electrical controls which are electrically connected to a smoke or detector within the elevator lobby.

Referring now to FIG. 12, this cut-away section of the control box 84 located in a remote location includes a transformer 92 and a timer 90 which in turn contains two three second transistors 91. This timer 90 operates to ensure that all power to the control box 84 is removed after the above described sealing operation has been completed. An alarm signal is sent from the smoke detector 36 to the control box 84 by way of the electrical conduit member 94. The transformer 92 is used to convert the 110 volt AC line voltage 116 within the building to 24 volts DC which is used to control the solenoid within the electric strike 76 to retract the plunger 78.

Various modifications may be made in and to the above described embodiment without departing from the spirit and scope this invention. For example, the present invention is not limited to the use of any particular types of fire retardant material or magnetic strips attached thereto. In addition, the present invention is not limited to the above specifically described electrical and mechanical apparatus for releasing the reels 38 from the housings or containers 32 upon receipt of an alarm signal from the smoke or fire detector 36. Furthermore, the present invention may be operated so that the reels 38 may fall either solely upon receipt of a smoke or fire alarm signal from the smoke or fire detector 36 or may be operated in a controlled acceleration mode for certain other types of passageway sealing applications. Furthermore, the present invention may be concealed above a false ceiling and may also provide a variety of seals at the bottom of the exit/entrance opening to provide differing sealing applications. In addition, the present invention may have the means for generating the elevator signals incorporated into the container 34.

The present invention is being tested in accordance with the 1990 edition of the Underwriter's Laboratories Subject No. 1784.

Listed in the Table below are the materials which have been used in the actual reduction to practice and the successful testing and operation of our invention and thereby represent the presently known best mode for practicing our invention. However, these materials are given by way of example only and are not intended to represent a limitation on the scope of our invention.

TABLE

| PREFERRED MATERIAL LIST | |
|---|---|
| FILM | 3 MIL KAPTON (DUPONT) |
| MAGNET | PM 14 N MULTIPOLE 0.125 (POLYMAG) |
| REEL | 0.012 B-REEL HANDED (SANDVIK SPRING STEEL) |
| LATCH | .006 24 v ELECTRIC DOOR OPENER 8080515CS |
| TRANSFORMER | 24 v AC HARDWARE NO. 125 CLAMP-ON TYPE 54840 G19AS |
| TIMER | NCC Q2F-00005 321-25-5SEC 12VAC x4 (2) 220k RESISTORS |
| TUBE | 4" DIAMETER ALUMINUM |
| BOX/HINGE | MANUFACTURED TO SPECS SHEET METAL |
| ADHESIVE | F9469PC x 2" A105 (3M) |
| SEALANT | 790 WITH 737 PRIMER (DOW CORNING) |
| LAM ADHESIVE | 583 SCOTCH-WELD (3M) |
| SHIM | .0040x 023 COLD ROLLED C1008/10 F.H.C.B. (LAPHAM HICKEY) |

Accordingly, it is to be understood that the above and other unspecified design and operational modifications may be made by those skilled in the art without departing from the scope of the following appended claims.

We claim:

1. An apparatus for sealing off selected exit ways and entrance ways in response to fire or smoke which comprises:

a. means including a fire resistant material having magnetic edge strips or sections thereon, said material being wound on a cylinder to which a spring reel is attached at each end and each spring reel having a wire wound thereon and being operative to restrain vertical acceleration of said first resistant material when dropped vertically from said exit and entrance ways, and b. means for releasing said cylinder in vertical fall and in close proximity adjacent to an exit way or an entrance way desired to be sealed off, whereby the magnetic edge strips falling in close proximity to said exit way or entrance way become rapidly pulled toward the surface thereof.

2. A fire resistant curtain having magnetic edge strips thereon and sized to be wound on a cylinder, whereby a vertical release of said cylinder adjacent to a passageway having metal or metallic sections thereon enables said magnetic edge strips to become magnetically attracted to said metal or metallic sections to thereby rapidly seal off said passageway, said magnetic edge strips having a laminating adhesive on one side thereof and thin metal strips adhered to the other side thereof, and said fire resistant material being attached to said magnetic edge strips which allows for expansion of said fire resistant material under pressure.

3. The invention defined in claim 2 wherein said curtain is wound on said cylinder and mounted in a housing adapted for mounting above a certain type of passageway, and means within said housing for releasing said cylinder in vertical fall adjacent to the edges of said passageway in response to a smoke or flame detection signal.

4. The invention defined in claim 3 wherein said cylinder includes spring reels mounted on each end thereof and having wires wound thereon and attached to an interior wall of said housing, whereby the rate of wire unwinding from said spring reels determines the vertical rate of descent of said cylinder along the vertical dimension of said passageway.

5. The invention defined in claim 4 wherein said releasing means further includes electrical control means connectable to a smoke detector and responsive to a signal from said smoke detector for releasing said cylinder from said housing.

6. The invention defined in claim 5 wherein said housing includes a door hinged at one end thereof, said door having a solenoid-operated latch mounted at the other end thereof and being responsive to said control signal for opening said door to thereby release said cylinder in vertical fall from said housing.

7. The invention defined in claim 6 wherein said cylinder is equipped with extension brackets which open due to the rotational momentum of said cylinder.

8. The invention defined in claim 7 wherein said housing for said curtain includes a control box containing a transformer and a timer therein whereby the timer allows power to be transmitted to said housing for only a short time duration and said transformer is operative to convert 110 volts AC current to 24 volts DC to operate said solenoid.

9. An apparatus for sealing off selected exit ways and entrance ways in response to fire or smoke which comprises:

a. means including a fire resistant material having magnetic edge strips or sections thereon, said material being wound on a cylinder to which a spring reel is attached and said spring reel having a wire wound thereon and being operative to restrain vertical acceleration of said fire resistant material when dropped vertically from said housing, b. means within said housing electrically coupled to a smoke or flame detector for releasing said cylinder in vertical fall and in close proximity adjacent to an exit way or an entrance way desired to be sealed off, whereby the magnetic edge strips falling in close proximity to said exit way or entrance way become rapidly pulled toward the surface thereof.

10. The invention defined in claim 9 wherein said releasing means further includes electrical control means connected to a smoke or flame detector and responsive to a signal from said smoke or flame detector for releasing said cylinder from said housing.

11. The invention defined in claim 10 wherein said housing includes a door hinged at one end thereof, said door having a solenoid operated latch mounted at the other end thereof and being responsive to said signal from said smoke or flame detector for opening said door to thereby release said fire resistant material in restrained vertical fall from said housing.

12. The invention defined in claim 11 wherein said cylinder is equipped with extension brackets which open due to the rotational momentum of said cylinder.

13. The invention defined in claim 12 wherein said housing includes a control box containing a transformer and a timer therein, whereby said timer allows power to be transmitted to said housing for only a short time duration, and said transformer is operative to convert 110 volts AC current to 24 volts DC to operate said solenoid.

14. The invention defined in claim 13 wherein said magnetic edge strips have a section of laminating adhesive on one side thereof and thin metal strips adhered to the other side thereof.

15. The invention defined in claim 14 wherein said fire resistant material is attached to said magnetic edge strips which allows for expansion under pressure.

* * * * *

UNITED STATES PATENT AND TRADEMARK OFFICE

CERTIFICATE OF CORRECTION

PATENT NO. : 5,195,594
DATED : March 23, 1993
INVENTOR(S) : Thomas H. Allen and Dale G. Hobson It is certified that error appears in the above-indentified patent and that said Letters Patent is hereby corrected as shown below:

In column 8, claim 1, line 37, please delete "first" and substitute therefor --fire--.

Signed and Sealed this

Sixteenth Day of August, 1994

*Attest:*

*Attesting Officer*

BRUCE LEHMAN

*Commissioner of Patents and Trademarks*